US007065489B2

(12) United States Patent
Hisaminato et al.

(10) Patent No.: US 7,065,489 B2
(45) Date of Patent: Jun. 20, 2006

(54) VOICE SYNTHESIZING APPARATUS USING DATABASE HAVING DIFFERENT PITCHES FOR EACH PHONEME REPRESENTED BY SAME PHONEME SYMBOL

(75) Inventors: Yuji Hisaminato, Hamamatsu (JP); Jordi Bonada Sanjaume, Barcelona (ES)

(73) Assignee: Yamaha Corporation, Hamamatsu (JP)

( * ) Notice: Subject to any disclaimer, the term of this patent is extended or adjusted under 35 U.S.C. 154(b) by 700 days.

(21) Appl. No.: 10/094,154

(22) Filed: Mar. 8, 2002

(65) Prior Publication Data

US 2002/0184032 A1 Dec. 5, 2002

(30) Foreign Application Priority Data

Mar. 9, 2001 (JP) ..... 2001-067258

(51) Int. Cl.
*G10L 13/04* (2006.01)

(52) U.S. Cl. ..... 704/268

(58) Field of Classification Search ..... 704/258–270
See application file for complete search history.

(56) References Cited

U.S. PATENT DOCUMENTS 5,642,470 A 6/1997 Yamamoto et al.

FOREIGN PATENT DOCUMENTS

| | | | |
|---|---|---|---|
| EP | 0942409 | A2 | 3/1999 |
| EP | 0 942 410 | A2 * | 9/1999 |
| EP | 1028409 | A2 | 1/2000 |
| JP | 02254497 | | 10/1990 |
| JP | 04-251297 | | 9/1992 |
| JP | 06308997 | | 4/1994 |
| JP | 06-308997 | | 11/1994 |
| JP | 6308997 | | 11/1994 |
| JP | 10-240264 | | 9/1998 |
| JP | 11003096 | | 6/1999 |

OTHER PUBLICATIONS

Cano, P. et al., "Voice morphing system for impersonating in karaoke applications," *Proceedings of the International Computer Music Conference 2000*, pp. 1-4, XP002246647, *p. 3, lines 22-37.

Japan Patent Office office Action JP 2001-067258 dated Sep. 25, 2001.

Japanese Patent Office, Office Action, Sep. 20, 2005.

* cited by examiner

*Primary Examiner*—Abul K. Azad
(74) *Attorney, Agent, or Firm*—Pillsbury Winthrop Shaw Pittman LLP

(57) ABSTRACT

A voice synthesizing apparatus comprises: a memory that stores phoneme pieces having a plurality of different pitches for each phoneme represented by a same phoneme symbol; a reading device that reads a phoneme piece by using a pitch as an index; and a voice synthesizer that synthesizes a voice in accordance with the read phoneme piece.

10 Claims, 10 Drawing Sheets

FIG. 3

| PHONEME NAME | PITCH[Hz] | FEATURE PARAMETER |
|---|---|---|
| /a/ | 200 | Pa1 |
| /a/ | 300 | Pa2 |
| /a/ | 400 | Pa3 |
| /i/ | 200 | Pi1 |
| /i/ | 300 | Pi2 |
| : | : | : |
| /o/ | 500 | Po4 |

FIG. 4

| PHONEME NAME | PITCH[Hz] | DYNAMICS | OPENING | FEATURE PARAMETER |
|---|---|---|---|---|
| /a/ | 200 | 0.8 | 0.4 | Pa1 |
| /a/ | 300 | 0.5 | 0.2 | Pa2 |
| /a/ | 400 | 0.6 | 0.8 | Pa3 |
| /i/ | 200 | 0.5 | 1 | Pi1 |
| /i/ | 300 | 0.3 | 0.7 | Pi2 |
| : | : | : | : | : |
| /o/ | 500 | 0.2 | 0.5 | Po4 |

FIG. 5

| PHONEME NAME | REPRESENTATIVE PITCH[Hz] | FEATURE PARAMETER |
|---|---|---|
| /a/ | 200 | {Pa1(t),Pitch_a1(t),Ta1} |
| /a/ | 300 | {Pa2(t),Pitch_a2(t),Ta2} |
| /a/ | 400 | {Pa3(t),Pitch_a3(t),Ta3} |
| /i/ | 200 | {Pi1(t),Pitch_i1(t),Ti1} |
| /i/ | 300 | {Pi2(t),Pitch_i2(t),Ti2} |
| : | : | : |
| /o/ | 500 | {Po4(t),Pitch_o4(t),To4} |

FIG. 6

| PRECEDING PHONEME NAME | SUCCEEDING PHONEME NAME | REPRESENTA-TIVE PITCH [Hz] | FEATURE PARAMETER |
|---|---|---|---|
| /a/ | /i/ | 200 | {Pai1(t),Pitch_ai1(t),Tai1} |
| /a/ | /i/ | 400 | {Pai2(t),Pitch_ai2(t),Tai2} |
| /a/ | /s/ | 300 | {Pas1(t),Pitch_as1(t),Tas1} |
| /a/ | /s/ | 500 | {Pas2(t),Pitch_as2(t),Tas2} |
| : | : | : | : |
| /s/ | /o/ | 500 | {Pso3(t),Pitch_so3(t),Tso3} |

FIG. 7

| PHONEME NAME | REPRESENTATIVE PITCH [Hz] | FEATURE PARAMETER |
|---|---|---|
| /a/ | 200 | {Pa1(t),Pitch_a1(t),Ta1} |
| /a/ | 300 | {Pa2(t),Pitch_a2(t),Ta2} |
| /a/ | 400 | {Pa3(t),Pitch_a3(t),Ta3} |
| /i/ | 200 | {Pi1(t),Pitch_i1(t),Ti1} |
| /i/ | 300 | {Pi2(t),Pitch_i2(t),Ti2} |
| : | : | : |
| /o/ | 500 | {Po4(t),Pitch_o4(t),To4} |

FIG. 8

| PRECEDING PHONEME NAME | SUCCEEDING PHONEME NAME | REPRESENTA-TIVE PITCH [Hz] | FEATURE PARAMETER |
|---|---|---|---|
| /a/ | /i/ | 200 | {Pai1(t),Pitch_ai1(t),Tai1} |
| /a/ | /i/ | 400 | {Pai2(t),Pitch_ai2(t),Tai2} |
| /a/ | /s/ | 300 | {Pas1(t),Pitch_as1(t),Tas1} |
| /a/ | /s/ | 500 | {Pas2(t),Pitch_as2(t),Tas2} |
| : | : | : | : |
| /s/ | /o/ | 500 | {Pso3(t),Pitch_so3(t),Tso3} |

VOICE SYNTHESIZING APPARATUS USING DATABASE HAVING DIFFERENT PITCHES FOR EACH PHONEME REPRESENTED BY SAME PHONEME SYMBOL

CROSS REFERENCE TO RELATED APPLICATION

This application is based on Japanese Patent Application No. 2001-067258, filed on Mar. 9, 2001, the entire contents of which are incorporated herein by reference.

BACKGROUND OF THE INVENTION

A) Field of the Invention

The present invention relates to a voice synthesizing apparatus, and more particularly to a voice synthesizing apparatus for synthesizing human singing voice.

B) Description of the Related Art

Human voice consists of phones or phonemes that consists of a plurality of formants. In synthesis of human singing voice, first, all formants constituting each of all phonemes that human can speak are generated to form necessary phones. Next, a plurality of generated phones are sequentially concatenated and pitches are controlled in accordance with the melody. This synthesizing method is applicable not only to human voices but also to musical sounds generated by a musical instrument such as a wind instrument.

A voice synthesizing apparatus utilizing this method is already known. For example, Japanese Patent No. 2504172 discloses a formant sound generating apparatus which can generate a formant sound having even a high pitch without generating unnecessary spectra.

It is known that the formant frequency depends upon a pitch. As disclosed in JP-A-HEI-6-308997, a database storing several phonemes at each pitch is used to select proper phoneme pieces in accordance with the voice pitch.

Since such a conventional database requires that each phoneme consists of several phoneme pieces that have different pitches, the size of the database becomes relatively large.

Further, since it is necessary to derive phoneme pieces from voices vocalized at a number of different pitches, it takes a long time to configure the database.

Furthermore, since the formant frequency does not depend only upon the pitch, but it depends also upon other parameters such as dynamics, the data amount increases in the unit of square and cube.

SUMMARY OF THE INVENTION

It is an object of the present invention to provide a voice synthesizing apparatus capable of reducing the size of a database while deterioration of the sound quality is minimized.

It is another object of the invention to provide a voice synthesizing apparatus using such a database.

According to one aspect of the present invention, there is provided a voice synthesizing apparatus comprising: a memory that stores phoneme pieces having a plurality of different pitches for each phoneme represented by a same phoneme symbol; a reading device that reads a phoneme piece by using a pitch as an index; and a voice synthesizer that synthesizes a voice in accordance with the read phoneme piece.

According to another aspect of the present invention, there is provided a voice synthesizing apparatus comprising: a memory that stores phoneme pieces having a plurality of different musical expressions for each phoneme represented by a same phoneme symbol; a reading device that reads a phoneme piece by using the musical expression as an index; and a voice synthesizer that synthesizes a voice in accordance with the read phoneme piece.

According to a further aspect of the present invention, there is provided a voice synthesizing apparatus comprising: a memory that stores a plurality of different phoneme pieces for each phoneme represented by a same phoneme symbol; an input device that inputs voice information for voice synthesis; an interpolation device that calculates a phoneme piece matching the voice information by interpolation using the phoneme pieces stored in said memory, if the phoneme piece matching the voice information is not stored in said memory; and a voice synthesizer that synthesizes a voice in accordance with the phoneme piece calculated through interpolation.

According to a still further aspect of the present invention, there is provided a voice synthesizing apparatus comprising: a memory that stores a change amount of a voice feature parameter as template data; an input device that inputs voice information for voice synthesis; a reading device that reads the template data from said memory in accordance with the voice information; and a voice synthesizer that synthesizes a voice in accordance with the read template data and the voice information.

As above, it is possible to provide a voice synthesizing database with a reduced size while deterioration of the voice quality is minimized.

It is also possible to provide a voice synthesizing apparatus capable of synthesizing more realistic human voices of a song and singing the song in a state without unnaturalness.

BRIEF DESCRIPTION OF THE DRAWINGS

FIG. 3 is a diagram showing an example of a Timbre database TDB.

FIG. 4 is a diagram showing another example of a Timbre database TDB.

FIG. 5 is a diagram showing an example of a stationary template database.

FIG. 6 is a diagram showing an example of an articulation template database.

FIG. 7 is a diagram showing an example of an NA template database NADB.

FIG. 8 is a diagram showing an example of an NN template database NNDB.

DESCRIPTION OF THE PREFERRED EMBODIMENTS

Figure 1:
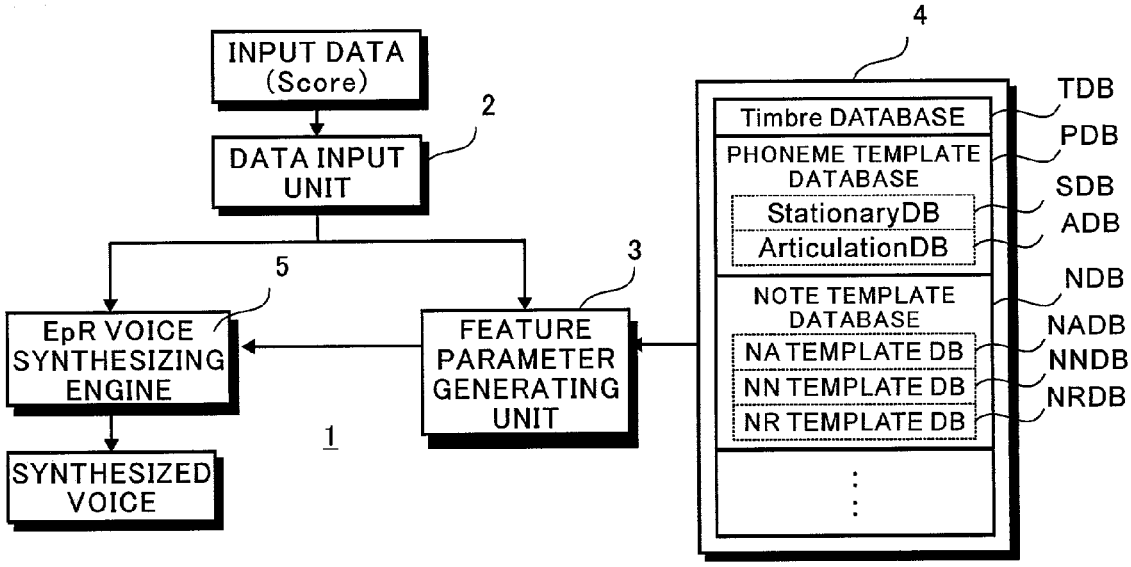
FIG. 1 is a block diagram showing the structure of a voice synthesizing apparatus 1 according to an embodiment of the invention.

FIG. 1 is a block diagram showing the structure of a voice synthesizing apparatus 1.

The voice synthesizing apparatus 1 has a data input unit 2, a feature parameter generating unit 3, a database 4 and an EpR voice synthesizing engine 5.

Input data Score input to the data input unit 2 is sent to the feature parameter generating unit 3 and EpR voice synthesizing engine 5. In accordance with the input data Score, the feature parameter generating unit 3 reads feature parameters and various templates to be described later from the database 4. The feature parameter generating unit 3 applies various templates to the read feature parameters to generate final feature parameters and send them to the EpR voice synthesizing engine 5.

The EpR voice synthesizing unit 5 generates pulses in accordance with the pitches, dynamics and the like of the input data Score, and applies feature parameters to the generated pulses to synthesize and output voices.

Figure 2:
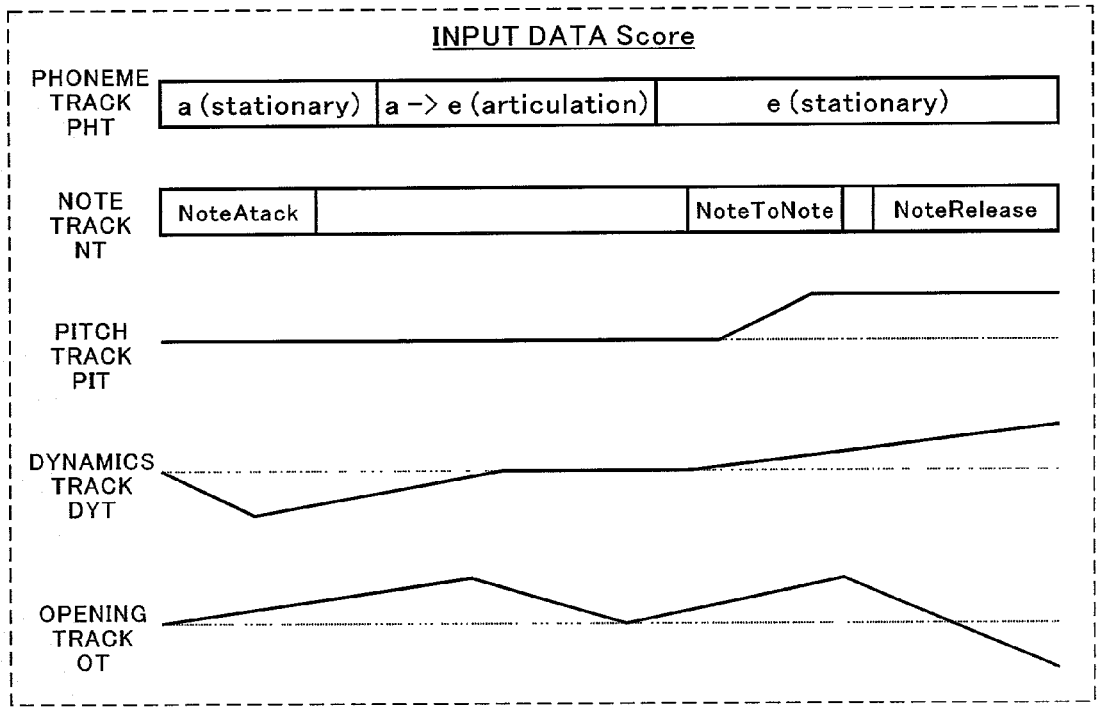
FIG. 2 is a conceptual diagram showing an example of input data Score.

FIG. 2 is a conceptual diagram showing an example of the input data Score. The input data Score is constituted of a phoneme track PHT, a note track NT, a pitch track PIT, a dynamics track DYT, and an opening track OT. The input data Score is song data of song phrases or the whole song, and changes with time.

The phoneme track PHT includes phoneme names and their voice production continuation times. Each phoneme is classified into two parts: Articulation representative of a transition part between phonemes; and Stationary representative of a stationary part. Each phoneme includes flags for distinguishing between Articulation and Stationary. Since Articulation is the transition part, it has phoneme names, namely preceding and succeeding phoneme names. Since Stationary is the stationary part, it has only one phoneme name.

The note track NT records flags each indicating one of a note attack (NoteAttack), a note-to-note (NoteToNote) and a note release (NoteRelease). NoteAttack, NoteToNote and NoteRelease are commands for designating musical expression at the rising (attack) time of voice production, at the pitch change time, and at the falling (release) time of voice production, respectively.

The pitch track PIT records the fundamental frequency at each timing of a voice to be vocalized. The pitch of an actually generated sound is calculated in accordance with pitch information recorded in the pitch track PIT and other information. Therefore, the pitch of an actually produced sound may differ from the pitch recorded in this pitch track PIT.

The dynamics track DYT records a dynamics value at each timing, which value is a parameter indicating an intensity of voice. The dynamics value takes a value from 0 to 1.

The opening track OT records an opening value at each timing, which value is a parameter indicating the opening degree of lips (lip opening degree). The opening value takes a value from 0 to 1.

In accordance with the input data Score input from the data input unit 2, the feature parameter generating unit 3 reads data from the database 4, and as will be later described, generates feature parameters in accordance with the input data Score and the data read from the database 4, and outputs the feature parameters to the EpR voice synthesizing engine 5.

The feature parameters to be generated by the feature parameter generating unit 3 can be classified, for example, into four types: an envelope of excitation waveform spectra; excitation resonances; formants; and differential spectra. These four feature parameters can be obtained by resolving a spectrum envelope (original spectrum envelope) of harmonic components obtained by analyzing voices (original voices) of a person or the like.

The envelope (ExcitationCurve) of excitation waveform spectra is constituted of three parameters: EGain indicating an amplitude (dB) of a glottal waveform; ESlopeDepth indicating a slope of the spectrum envelope of the glottal waveform; and ESlope indicating a depth (dB) from a maximum value to a minimum value of the spectrum envelope of the glottal waveform. ExcitationCurve can be expressed by the following equation (A):

$$\text{ExcitationCurve}(f)=E\text{Gain}+E\text{SlopeDepth}*(\exp(-E\text{Slope}*f)-1) \quad \text{(A)}$$

The excitation resonance is a chest resonance. The excitation resonance is constituted of three parameters including a center frequency (ERFreq), a band width (ERBW) and an amplitude (ERAmp), and has the second-order filter characteristics.

The formant indicates a vocal tract resonance made of twelve resonances. The formant is constituted of three parameters including a center frequency (FormantFreqi), a band width (FormantBW1) and an amplitude (FormantAmpi), where "i" takes a value from 1 to 12 ($1 \leqq i \leqq 12$).

The differential spectrum is a feature parameter which has a differential spectrum from the original spectrum, the differential spectrum being unable to be expressed by the three parameters: the envelope of excitation waveform spectra, excitation resonances and formants.

The database 4 is constituted of, at least a Timbre database TDB, a phoneme template database PDB and a note template database NDB.

In general, if voices are synthesized by using only feature parameters at a specific timing stored in the Timbre database TDB, the synthesized voices become very monotonous and mechanical. If phonemes are continuously generated, voices in the transition part between phonemes change gradually in the actual case. Therefore, if the stationary parts of phonemes are simply concatenated, a very unnatural voice is produced at the concatenated point. These disadvantages can be mitigated by voice synthesis using the phoneme template and note template.

Timbre is a tone color of a phoneme and is expressed by feature parameters at one timing point (a set of the excitation spectrum, excitation resonance, formant and differential spectrum). FIG. 3 shows an example of the Timbre database TDB. This database has a phoneme name and a pitch as its indices.

Although the Timbre database TDB shown in FIG. 3 is used in this embodiment, a database having four indices including the phoneme name, pitch, dynamics and opening such as shown in FIG. 4 may be used.

The phoneme template database PDB is constituted of a stationary template database and an articulation template database. The template is a set of a sequence having: pairs of a feature parameter P and a pitch Pitch disposed at a predetermined time interval; and a length T (sec) of the sequence. The template can be expressed by the following equation (B):

$$\text{Template}=\{P(t),\text{Pitch}(t),T\} \quad \text{(B)}$$

where $t=0, \Delta t, 2\Delta t, 3\Delta t, \ldots, T$. In this embodiment, $\Delta t$ is 5 ms.

As $\Delta t$ is made short, although the sound quality becomes good because of a high time resolution, the size of the database becomes large. Conversely, as Δt is made long, although the sound quality becomes bad, the size of the database becomes small. When Δt is determined, the priority order of the sound quality and database size is taken into consideration.

FIG. 5 shows an example of the stationary template database. The stationary template database uses a phoneme name and a representative pitch as its indices, and has stationary templates of all phonemes of voiced sounds. The stationary template can be created by analyzing voices having stable phonemes and pitches by utilizing an EpR model.

If one voice of a voiced sound, e.g., "a", is produced during a prolonged period at some pitch, e.g., at C4, it can be said that the feature parameters such as pitches and formant frequencies are generally constant and stationary. However, there is some fluctuation in an actual case. If this fluctuation does not exist and the feature parameters are perfectly constant, synthesized voices are flat and mechanical. In other words, this fluctuation expresses the individuality and naturalness of each person.

When a voice of a voiced sound is synthesized, not only Timbre, i.e., the feature parameters at one timing, are used, but adding to it fluctuation of feature parameters and pitches derived from voices of an actual person and stored in the stationary templates gives the voice of a voiced sound the naturalness.

In synthesizing voices of a song, it is necessary to change a sound production time with the length of each note. However, only a single long template is prepared. If we synthesize a voiced sound longer than the template, this template is directly applied starting from the leading part of the voice of a voiced sound without stretching or shrinking the time axis of the template.

If the voice reaches the end of the template, the same template is again applied from the time point. If the voice reaches the end of the template, a template with a reversed time axis may be applied. With this method, discontinuity at the connection point between the templates does not exist.

If the time axis of the template is stretched or shortened, the speed of a change in the feature parameters and pitches change greatly and the naturalness is degraded. It is preferable not to change the time axis of the template, also from the viewpoint that a human being does not consciously control the fluctuation in the stationary part.

The stationary template does not have the time series of feature parameters themselves in the stationary part, but it has representative typical feature parameters of each phoneme and change amounts of the feature parameters. The change amounts of the feature parameters in the stationary part are small. Therefore, as compared to having feature parameters themselves, having the change amounts reduces the information amount so that the size of the database can be made small.

FIG. 6 shows an example of the articulation template database. The articulation template database uses a preceding phoneme name, a succeeding phoneme name, and a representative pitch as its indices. In the articulation template database, the articulation template has combinations of phonemes of a language which phonemes can be actually realized.

The articulation template can be obtained by analyzing voices of phonemes in the concatenated part with a stable pitch by utilizing an EpR model.

The feature parameter P(t) may be either an absolute value or a differential value. As will be later described, the absolute values of these templates are not directly used for voice synthesis, but the relative change amounts of parameters are used. Therefore, in accordance with the template application method, the feature parameters are recorded in the form of a difference from P(t=T), a difference from P(0), or a difference from a straight line interconnecting P(0) and P(T) as shown in the following equations (C1 to C3):

$$\text{Template1}=\{P(t)-P(T),\text{Pitch}(t)-\text{Pitch}(T),T\} \tag{C1}$$

$$\text{Template2}=\{P(t)-P(0),\text{Pitch}(t)-\text{Pitch}(0),T\} \tag{C2}$$

$$Template3=\left\{\begin{matrix} P(t)-((P(T)-P(0))*t/T+P(0)), \\ Pitch(t)-((Pitch(T)-Pitch(0))*t/T+Pitch(0)),\ T \end{matrix}\right\} \tag{C3}$$

When a person utters two phonemes continuously, the voices do not change abruptly, but utterance of the voices changes gradually. For example, if after a vowel "a" is pronounced, a vowel "e" is pronounced continuously without any pose, the vowel "a" is first produced, and a voice intermediate of "a" and "e" is generated to change to "e".

This phenomenon is generally called co-articulation. In order to synthesize providing a natural concatenated phonemes, it is preferable to provide voice information in the concatenated part in some desired form for each of combinations of phonemes of a language which phonemes can be actually realized.

It is already know that the concatenating part between phonemes is provided in the form of LPC coefficients and speech waveforms. In this embodiment, the articulation part between two phonemes is synthesized by using an articulation template having differential information of feature parameters and pitches.

For example, consider the case wherein a song having two continuous words "a" and "i" of a quarter note at the same pitch is synthesized. There is a transition part from "a" to "i" in the boundary area between two notes. Both "a" and "i" are vowels and a voiced sound. This transition part corresponds to an articulation from V (voiced sound) to V (voiced sound). In this case, the feature parameters in the transition part can be obtained by applying the articulation template by using a method of Type 2 to be described later.

Namely, the feature parameters of "a" and "i" are read from the Timbre database TDB and the articulation template from "a" to "i" is applied to the feature parameters. In this manner, the feature parameters having a natural change of the transition part can be obtained.

If the time of the transition part from "a" to "i" is set to the original time of the articulation template to be applied to the transition part, the same change as that of voice waveforms used when the template was formed can be obtained.

In synthesizing a voice changing slower or longer than the template time, after the length of the template is linearly stretched, a difference of feature parameters is added. As different from the stationary part described earlier, since the speed of a change part between two phonemes can be controlled consciously, even if the template is linearly stretched, naturalness is not damaged greatly.

Next, consider the case wherein a song having two continuous words "a" and "su" of a quarter note at the same pitch is synthesized. There is a short transition part from "a" to the consonant of "su", that is "s", in the boundary area between two notes. This transition part corresponds to an articulation from V (voiced sound) to U (unvoiced sound). In this case, the feature parameters in the transition part can be obtained by applying the articulation template by using a method of Type 1 to be described later.

Feature parameters of "a" are read from the Timbre database TDB and an articulation template from "a" to "s" is applied to the read feature parameters. In this manner, the feature parameters having a natural change of the transition part can be obtained.

The reason why Type 1, i.e., a difference from the start part of the template, is used for the articulation from V (voiced sound) to U (unvoiced sound) is simply because pitches and feature parameters do not exist in U (unvoiced sound) corresponding to the end part.

"su" is constituted of a consonant "s" and a vowel "u". A transition part also exists in the boundary area where "u" is pronounced while keeping the sound "s". This articulation part corresponds to the articulation from U to V so that the articulation template is applied by using the method of Type 1.

Feature parameters of "u" are read from the Timbre database TDB and an articulation template from "s" to "u" is applied to the feature parameters to obtain the feature parameters of the transition part from "s" to "u".

The articulation template having differential information of feature parameters is advantageous in that the data size becomes smaller than the template having absolute value feature parameters.

The note template database NDB has at least a note attack template (NA template) database NADB, a note release template (NR template) database NRDB, and a note-to-note template (NN template) database NNDB.

FIG. 7 shows an example of the NA template database NADB. The NA template has information of feature parameters and pitches in the voice rising part.

The NA template database NADB stores NA templates for phonemes of all voiced sounds by using a phoneme name and a representative pitch as indices. The NA template is obtained by analyzing actually produced voices in the rising part.

The NR template has information of the feature parameters and pitches in the voice falling part. The NR template database NRDB has the same structure as that of the NA template database NADB, and has NR templates for phonemes of all voiced sounds by using a phoneme name and a representative pitch as indices.

As the rising part (Attack) of a phoneme vocalized at a certain pitch, e.g., "a" is analyzed, it can be seen that the amplitude becomes gradually large and stabilizes when it takes a certain level. Not only the amplitude value, but also the formant frequency, formant bandwidth and pitch also change.

If the NA template obtained by analyzing the rising part of an actual human voice, e.g., "a" is applied to the feature parameters of the stationary part, a natural change in the human voice in the rising part can be given.

If NA templates for all phonemes are prepared, it is possible to give a change in every phoneme to the attack part.

A song is sung by making the rising speed up and down in order to give particular musical expression. Although the NA template has one rising time, the speed in the rising part of the NA template can be increased or decreased by linearly expanding or contracting the time axis of the template.

It is known from experiments that unnaturalness of the attack part does not occur if the expansion/contraction of the template is in the range of several times. In order to perform voice synthesis by designating the length of the attach park in the wider range, NA templates having lengths at several levels may be prepared and the template having the length nearest to the attack part is selected and expanded or contracted. Other methods may also be used.

Similar to the rising (Attack) part, the amplitudes, pitches and formants change in the end part of an utterance, i.e., falling (Release) part.

In order to give a natural change of human voices to the falling part, an NR template obtained by analyzing human actual voices in the falling part is applied to the feature parameters of a phoneme just before the start of the falling part.

FIG. 8 shows an example of the NN template database NNDB. The NN template has the feature parameters of voices in the pitch changing part. The NN template data base NNDB stores NN templates for all phonemes of voiced sounds and has as indices a phoneme name, a pitch at the start timing of the template and a pitch at the end timing of the template.

There is a singing method of continuously singing two notes having different pitches without any pose by smoothly changing the pitch of the preceding note to the pitch of the succeeding note. Although it is obvious that the pitch and amplitude change, the voice frequency characteristics such as the formant frequency also change finely even if pronunciation of the preceding and succeeding two notes are the same (e.g., the same "a").

By using the NN template obtained by analyzing a change in actual human voices by changing the pitch from the start point to end point, natural musical expression can be given in the boundary area between notes having different pitches.

In an actual musical melody, there are many combinations of pitch changes even in the compass of 2 octaves or 24 semi-tones. However, even if the absolute values of pitches are different, a template having a small pitch difference can be used as a substitute so that NN templates for all pitch change combinations are not required to be prepared.

As will be later described, in selecting the NN template, a template having a small pitch change width is selected with a priority over a template having a small pitch absolute value difference. The selected NN template is applied by using a method of Type 3 to be later described.

The reason why the NN template having the small pitch change width is selected is as follows. There is a possibility that the NN template obtained from the part where the pitch changes greatly has big values. If this NN template is applied to the part where the pitch change width is small, the change shape of the original NN template cannot be retained and there is a possibility that the change becomes unnatural.

An NN template obtained from a voice of a particular phoneme, e.g., "a" whose pitch changes may be used for the pitch change of all phonemes. However, in the environment that a large data size poses no problem, it is preferable to prepare NN templates for pitch changes of several patterns of each phoneme in order to generate synthesized sounds that are not monotonous and are rich in expression.

Next, the method of applying each template stored in the database 4 will be described. In applying a template to some section of the input data Score, the time axis of the template is stretched or shortened and a difference from a feature parameter of the template is added to one or a plurality of feature parameters at the reference point to obtain a train of feature parameters and pitches having the time length same as that of the section of Score. There are four template applying methods Type 1 to Type 4. In the following description, a template is expressed by {P(t), Pitch(t), T}.

First, the template applying method of Type 1 will be described. Type 1 is the template applying method that uses a start point. Applying the template applying method of Type 1 for a section K of the input data Score having a length T means calculating the feature parameter P't at the time t by the following equation (D):

$$P'_t = P_t + P(t \cdot T/T') - P(0) \quad \text{(D)}$$

where Pt is a set of feature parameters in the section K at the time t.

It is assumed that the start point of the template and section K is at the time t=0. The equation (D) means that a change amount from the start point of the template is added to the feature parameter at the time t.

Type 1 is used mainly when the template is applied to the feature parameter in the note release part. The reason for this is as follows. A voice in the stationary part exists in the start portion of the note release so that it is necessary to maintain the parameter continuity, i.e., voice continuity in the start portion of the note release, whereas no voice exists in the end portion of the note release so that it is not necessary to maintain the parameter continuity.

Next, the template applying method of Type 2 will be described. Type 2 is the template applying method that uses an end point. Applying the template applying method of Type 2 for a section K of the input data Score having a length T means calculating the feature parameter P't at the time t by the following equation (E):

$$P'_t = P_t + P(t \cdot T/T') - P(T) \quad \text{(E)}$$

where Pt is a set of the feature parameters in the section K at the time t.

It is assumed that the start point of the template and section K is at the time t=0. The equation (E) means that a change amount from the end point of the template is added to the feature parameter at the time t.

Type 2 is used mainly when the template is applied to the feature parameter in the note attack part. The reason for this is as follows. A voice in the stationary part exists in the end portion of the note attack so that it is necessary to maintain the parameter continuity, i.e., voice continuity in the end portion of the note attack, whereas no voice exists in the start portion of the note attack so that it is not necessary to maintain the parameter continuity.

Next, the template applying method of Type 3 will be described. Type 3 is the template applying method that uses both the start and end points. Applying the template applying method of Type 3 for a section K of the input data Score having a length T means calculating the feature parameter P't at the time t by the following equation (F):

$$P'_t = P_0 + \frac{t}{T'}(P_t - P_0) + \left(P(t \cdot T/T') - \frac{t}{T'}(P(T) - P(0))\right) \quad \text{(F)}$$

where Pt is a set of the feature parameters in the section K at the time t.

It is assumed that the start point of the template and section K is at the time t=0. The equation (F) means that a difference from the straight line interconnecting the start and end points of the template is added to the straight line interconnecting the start and end points of the section K.

Next, the template applying method of Type 4 will be described. Type 4 is the template applying method that uses a stationary type. Applying the template applying method of Type 4 for a section K of the input data Score having a length T means calculating the feature parameter P't at the time t by the following equation (G):

$$P'_t = P_t + P(t \bmod T) - P(0) \quad \text{(G)}$$

where Pt is a set of the feature parameters in the section K at the time t.

It is assumed that the start point of the template and section K is at the time t=0. The equation (G) means that a change amount from the start point of the template is added to the section K repetitively at every T.

Type 4 is used mainly when the template is applied to the stationary part. Type 4 gives natural fluctuation to the relatively long stationary part of a voice.

Figure 9:
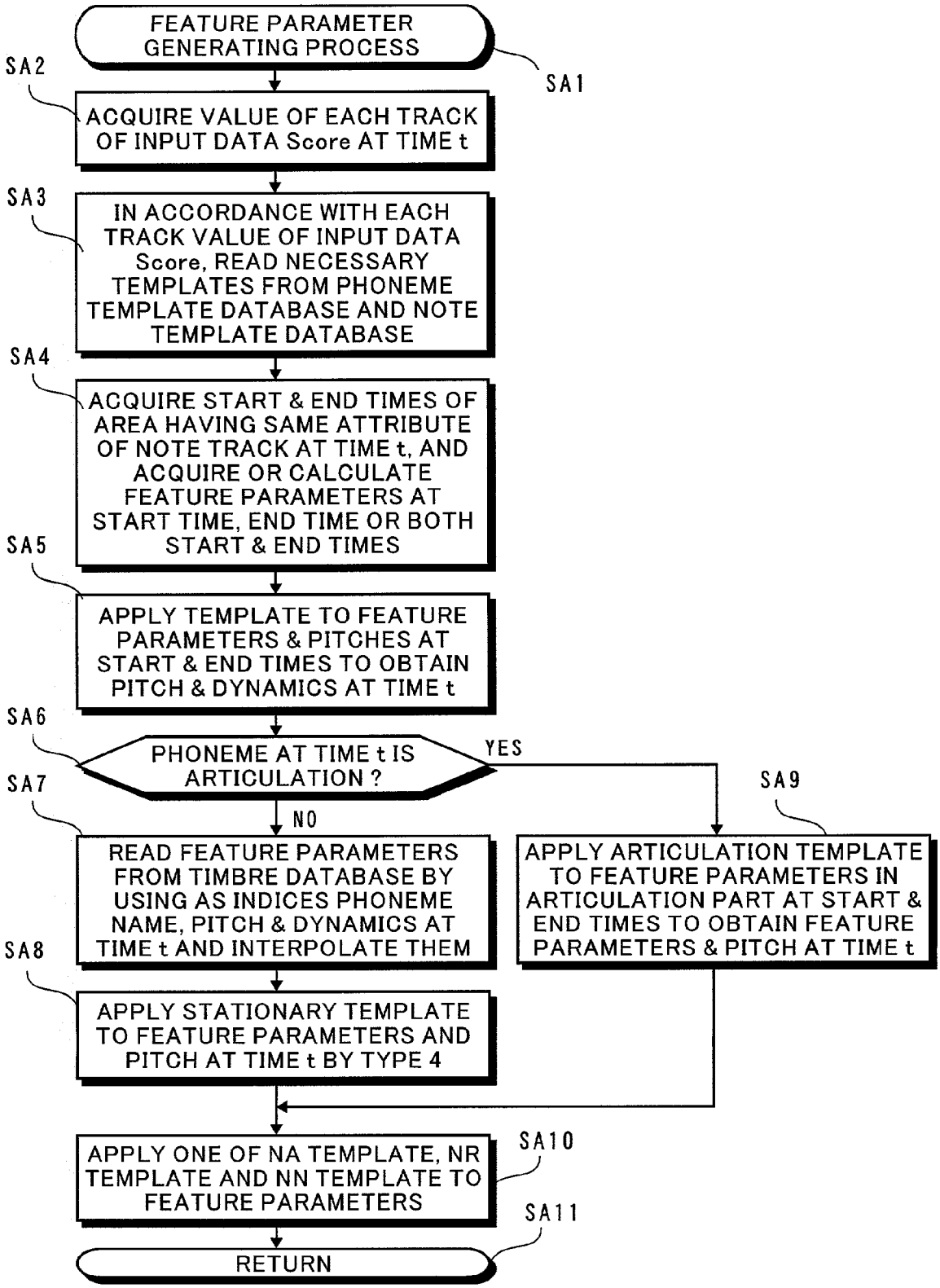
FIG. 9 is a flow chart illustrating a feature parameter generating process.

FIG. 9 is a flow chart illustrating a feature parameter generating process. This process generates feature parameters at the time t. The feature parameters generating process repeats at a predetermined time interval increasing the time t to synthesize whole voices in the phrase or song.

At Step SA1 the feature parameter generating process starts to thereafter advance to the next Step SA2.

At Step SA2 values of each track of the input data Score at the time t are acquired. Specifically, of the input data Score at the time t, the phoneme name, distinguishment between articulation and stationary, distinguishment between note attack, note-to-note and note release, a pitch, a dynamics value and an opening value are acquired. Thereafter, the flow advances to the next Step SA3.

At Step SA3 in accordance with the value of each track of the input data Score acquired at Step SA2, necessary templates are read from the phoneme template database PDB and note template database NDB. Thereafter, the flow advances to the Next Step SA4.

Reading the phoneme template at Step SA3 is performed, for example, by the following procedure. If it is judged that the phoneme at the time t is articulation, the articulation template database is searched to read a template having the coincident preceding and succeeding phoneme names and the nearest pitch.

If it is judged that the phoneme at the time t is stationary, the stationary template database is searched to read a template having the coincident phoneme name and the nearest pitch.

Reading the note template is performed by the following procedure. If it is judged that the note track at the time t is note attack, the NA template database NADB is searched to read a template having the coincident phoneme name and the nearest pitch.

If it is judged that the note track at the time t is note release, the NR template database NRDB is searched to read a template having the coincident phoneme name and the nearest pitch.

If it is judged that the note track at the time t is note-to-note, the NN template database NNDB is searched to read a template having the coincident phoneme names and the nearest distance d. The distance d is calculated by the following equation (H) by using the start pitches and end pitches. The equation (H) uses as a distance scale the value obtained by adding a weighted change amount of frequencies and a weighted change amount of average values.

$$d = 0.8 \cdot |\text{TempInterval} - \text{Interval}| + 0.2 \cdot |\text{TempAve} - \text{Ave}| \quad \text{(H)}$$

where

TempInterval=|template start point pitch−template end point pitch|,

TempAve=(template start point pitch+template end point pitch)/2,

Interval=|note track start point pitch−note track end point pitch|, and

Ave=(note track start point pitch+note track end point pitch)/2.

By reading the template in accordance with the distance d calculated by the equation (H), the template having the nearest pitch change amount rather than the nearest pitch absolute value can be read.

At Step SA4 the start and end times of the area having the same attribute of the note track at the current time t are acquired. If the phoneme track is stationary, in accordance with distinguishment between note attack, note-to-note and note release, the feature parameters at the start time, end time or at the start and end times is acquired or calculated. Thereafter, the flow advances to the next Step SA5.

If the note track at the time t is note attack, the Timbre database TDB is searched to read feature parameters having the coincident phoneme name and the coincident pitch at the note attack end time.

If there is no feature parameter having the coincident pitch, two sets of feature parameters having the coincident phoneme name and the pitches sandwiching the pitch at the note attack end time are acquired. The two sets of feature parameters are interpolated to calculate the feature parameters at the note attack end time. The details of interpolation will be later given.

If the note track at the time t is note release, the Timbre database TDB is searched to read feature parameters having the coincident phoneme name and the coincident pitch at the note attack start time.

If there is no feature parameter having the coincident pitch, two sets of feature parameters having the coincident phoneme name and the pitches sandwiching the pitch at the note attack start time are acquired. The two sets of feature parameters are interpolated to calculate the feature parameters at the note attack start time. The details of interpolation will be later given.

If the note track at the time t is note-to-note, the Timbre database TDB is searched to read feature parameters having the coincident phoneme name and the coincident pitch at the note-to-note end time.

If there is no feature parameter having the coincident pitch, two sets of feature parameters having the coincident phoneme name and the pitches sandwiching the pitch at the note-to-note start (end) time are acquired. The two sets of feature parameters are interpolated to calculate the feature parameters at the note-to-note start (end) time. The details of interpolation will be later given.

If the phoneme track is articulation, the feature parameters at the start and end times are acquired or calculated. In this case, the Timbre database TDB is searched to read feature parameters having the coincident phoneme names and the coincident pitch at the articulation start time and a feature parameter having the coincident phoneme names and the coincident pitch at the articulation end time.

If there is no feature parameter having the coincident pitch, two sets of feature parameters having the coincident phoneme names and the pitches sandwiching the pitch at the articulation start (end) time are acquired. The two sets of feature parameters are interpolated to calculate the feature parameters at the articulation start (end) time.

At Step SA5, the template read at Step SA3 is applied to the feature parameters and pitches at the start and end times read at Step SA4 to obtain the pitch and dynamics at the time t.

If the note track at the time t is note attack, the NA template is applied to the note attack part by Type 2 by using the feature parameters of the note attack part at the end time read at Step SA4. After the template is applied, the pitch and dynamics (EGain) at the time t are stored.

If the note track at the time t is note release, the NR template is applied to the note release part by Type 1 by using the feature parameters of the note release part at the note release start point read at Step SA4. After the template is applied, the pitch and dynamics (EGain) at the time t are stored.

If the note track at the time t is note-to-note, the NN template is applied to the note-to-note part by Type 3 by using the feature parameters of the note-to-note start and end times read at Step SA4. After the template is applied, the pitch and dynamics (EGain) at the time t are stored.

If the note track at the time t is none of the above-described parts, the pitch and dynamics (EGain) of the input data Score are stored.

After one of the above-described processes is performed, the flow advances to the next Step SA6.

At Step SA6 it is judged from the values of each track obtained at Step SA2 whether the phoneme at the time t is articulation or not. If the phoneme is articulation, the flow branches to Step SA9 indicated by a YES arrow, whereas if not, i.e., if the phoneme at the time t is stationary, the flow advances to Step SA7 indicated by a NO arrow.

At Step SA7 the feature parameters are read from the Timbre database TDB by using as indices the phoneme name obtained at Step SA2 and the pitch and dynamics obtained at Step SA5. The feature parameters are used for interpolation. A read and interpolation method is similar to that used at Step SA4. Thereafter, the flow advances to Step SA8.

At Step SA8 the stationary template obtained at Step SA3 is applied to the feature parameters and pitch at the time t obtained at Step SA7 by Type 4.

By applying the stationary template at Step SA8, the feature parameters and pitch at the time t are renewed to add voice fluctuation given by the stationary template. Thereafter, the flow advances to Step SA10.

At Step SA9 the articulation template read at Step SA3 is applied to the feature parameters in the articulation part obtained at Step SA4 at the start and end times to obtain the feature parameters and pitch at the time t. Thereafter, the flow advances to Step SA10.

In applying the template, Type 1 is used for a transition from a voiced sound (V) to an unvoiced sound (U), Type 2 is used for a transition from a unvoiced sound (U) to a voiced sound (V), and Type 3 is used for a transition from a voiced sound (V) to an unvoiced sound (U) or a transition from a unvoiced sound (U) to a voiced sound (V).

The template applying method is alternatively used in the manner described above in order to realize a natural voice change contained in the template while maintaining continuity of the voiced sound part.

At Step SA10 one of the NA template, NR template and NN template is applied to the feature parameters obtained at Step SA8 or SA9. The template is not applied to EGain of the feature parameters. Thereafter, the flow advances to Step SA11 whereat the feature parameter generating process is terminated.

In applying the template at Step SA10, if the note track at the time t is note attack, the NA template obtained at Step SA3 is applied by Type 2 to renew the feature parameters.

If the note track at the time t is note release, the NR template obtained at Step SA3 is applied by Type 1 to renew the feature parameters.

If the note track at the time t is note-to-note, the NN template obtained at Step SA3 is applied by Type 3 to renew the feature parameters.

If the note track at the time t is none of the above-described parts, the template is not applied to EGain of the feature parameters. The pitch obtained before Step 10 is directly used.

Interpolation for feature parameters to be performed at Step SA4 shown in FIG. 9 will be described. Interpolation for feature parameters includes interpolation of two sets of feature parameters and estimation from one set of feature parameters.

It is known that if the pitch is changed when a person utters a voice, the glottal waveform (sound source waveform generated by air from the lung and vibration of the vocal cord) changes, and that the formants change with the pitch. If feature parameters obtained from voices at one pitch are directly used for synthesizing voices at another pitch, synthesized voices have a tone color like that of the original voices even if the pitch is changed and are unnatural.

In order to avoid this, feature parameters are stored in the Timbre database TDB by selecting about three points at an equal interval on the logarithmic axis of the compass of two to three octaves corresponding to the human singing compass. In order to synthesize voices at a pitch different from the pitches stored in the Timbre database TDB, the feature parameters are obtained through interpolation (linear interpolation) of two sets of feature parameters or estimation (extrapolation) from one set of feature parameters.

By using this method, a change in feature parameters of voices at different pitches can be expressed mimetically. Feature parameters at different pitches are prepared at about three points. The reason for this is as follows. Even if a voice has the same phoneme and pitch, the feature parameters changes with time. Therefore, a difference between interpolation at about three points and interpolation at finely divided points is less meaningful.

In the interpolation by two sets of feature parameters, the feature parameters at a pitch f1 [cents] at the time t can be obtained by linear interpolation by using the following equation (I) when the two sets of feature parameters and a pair of pitches {P1, f1 [cents]} and {P2, f2 [cents]} are given:

$$P = \frac{|f_2 - f|}{|f_1 - f| + |f_2 - f|} P_1 + \frac{|f_1 - f|}{|f_1 - f| + |f_2 - f|} P_2 = P_1 + (P_2 + P_1)\frac{f - f_1}{|f_2 - f_1|} \quad \text{(I)}$$

In the equation (I), only one pitch is used as the search parameter of the database. If N indices are used, (N+1) data in the nearby area surrounding the target is used to obtain the feature parameters to be used as a substitute for the target index f from the following equation (I'):

$$P = \sum_{i=1}^{N+1} \frac{\left(\sum_{j=1}^{N+1} |fj - f|\right) - fi}{\sum_{j=1}^{N+1} |fj - f|} Pi \quad \text{(I')}$$

where Pi is the i-th nearby feature parameter and fi is its index.

The estimation from one set of feature parameters is utilized when the feature parameters outside of the compass of data stored in the database are estimated.

If the feature parameters having the highest pitch in the database are used for synthesizing voices having a pitch higher than the compass of the database, the sound quality is apparently degraded.

If the feature parameters having the lowest pitch in the database is used for synthesizing voices having a pitch lower than the compass of the database, the sound quality is also degraded. In this embodiment, therefore, the sound quality is prevented from being degraded by changing the feature parameters in the following manner by using rules basing upon knowing from observations of actual voice data.

First, synthesizing voices having a pitch (target pitch) higher than the compass of the database will be described.

First, a value PitchDiff [cents] is calculated by subtracting the highest pitch HighestPitch [cents] in the database from the target pitch TargetPitch [cents].

Next, the feature parameters having the highest pitch are read from the database. Of the feature parameters, the excitation resonance frequency EpRFreq and i-th formant frequency FormantFreqi are added with PitchDiff [cents] to obtain EpRFreq' and FormantFreqi' which are used as the feature parameters of the target pitch.

Next, synthesizing voices having a pitch (target pitch) lower than the compass of the database will be described.

First, a value PitchDiff [cents] is calculated by subtracting the lowest pitch LowestPitch [cents] in the database from the target pitch TargetPitch [cents].

Next, the feature parameters having the lowest pitch are read from the database. The feature parameters are replaced in the following manner to use the replaced feature parameters as the feature parameters at the target pitch.

First, the excitation resonance frequency EpRFreq and first to fourth formant frequencies FormantFreq ($1 \leqq i \leqq 4$) are replaced by EpRFreq' and FormantFreqi' by using the following equations (J1) and (J2):

$$ER\text{Freq}' = ER\text{Freq} + 0.25 \times \text{PitchDiff} \quad \text{(J1)}$$

$$\text{FormantFreq}_i' = \text{FormantFreq}_i + 0.25 \times \text{PitchDiff} \quad \text{(J2)}$$

In order to make the band width narrower as the pitch becomes lower, the excitation resonance band width ERBW and first to fourth formant band widths FormantBWi ($1 \leqq i \leqq 3$) are replaced by ERBW' and FormantBWi' by using the following equations (J3) and (J4):

$$ERBW' = \frac{ERBW}{1 - 3 \times PichDiff / 1200} \quad \text{(J3)}$$

$$\text{FormantFreq}_i' = \text{FormantFreq}_i + 0.25 \times \text{PitchDiff} \quad \text{(J4)}$$

The first to fourth formant amplitudes FormantAmp 1 to FormantAmp 4 are made large in proportion to PitchDiff by using the following equations (J5) to (J8) to be replaced by FormantAmp 1' to FormantAmp 4':

$$\text{FormantAmp}_1' = \text{FormantAmp}_1 - 8 \times \text{PitchDiff}/1200 \quad \text{(J5)}$$

$$\text{FormantAmp}_2' = \text{FormantAmp}_2 - 5 \times \text{PitchDiff}/1200 \quad \text{(J6)}$$

$$\text{FormantAmp}_3' = \text{FormantAmp}_3 - 12 \times \text{PitchDiff}/1200 \quad \text{(J7)}$$

$$\text{FormantAmp}_4' = \text{FormantAmp}_4 - 15 \times \text{PitchDiff}/1200 \quad \text{(J8)}$$

The slope Eslope of the spectrum envelope is replaced by Eslope' by using the following equation (J9):

$$E\text{Slope}' = E\text{Slope} \times (1 - 4 \times \text{PitchDiff}/1200) \quad \text{(J9)}$$

It is preferable to form the Timbre database TDB shown in FIG. 4 using the pitch, dynamics and opening as indices. However, if there are restrictions of time and database size, the database of this embodiment shown in FIG. 3 using only the pitch as the index is used.

The feature parameters using only the pitch as the index are changed by using a dynamics function and an opening function. In this case, the effects of using the Timbre database TDB using the pitch, dynamics and opening as indices can be obtained mimetically.

Namely, by using voices recorded by changing only the pitch, we can obtain voices as if they are recorded by changing the pitch, dynamics and opening can be obtained. The dynamics function and opening function can be obtained by analyzing a correlation between the feature parameters and the actual voices vocalized by changing the dynamics and opening.

Figure 10A:
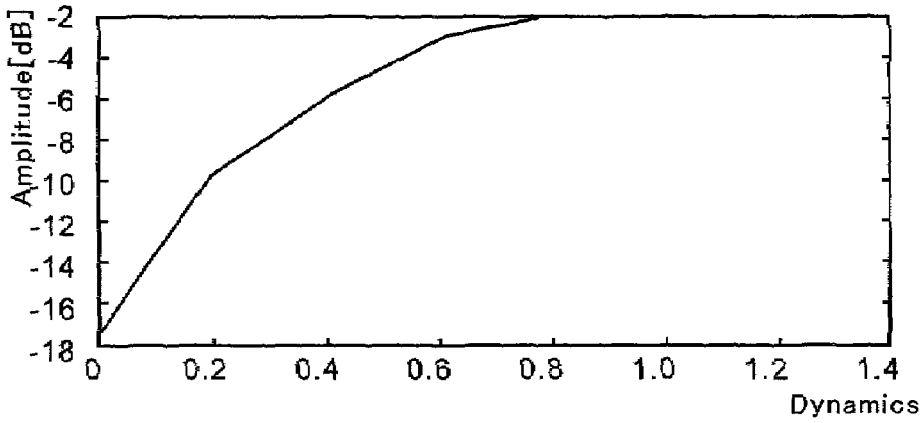
FIGS. 10A to 10C are graphs showing examples of dynamics functions.
Figure 10B:
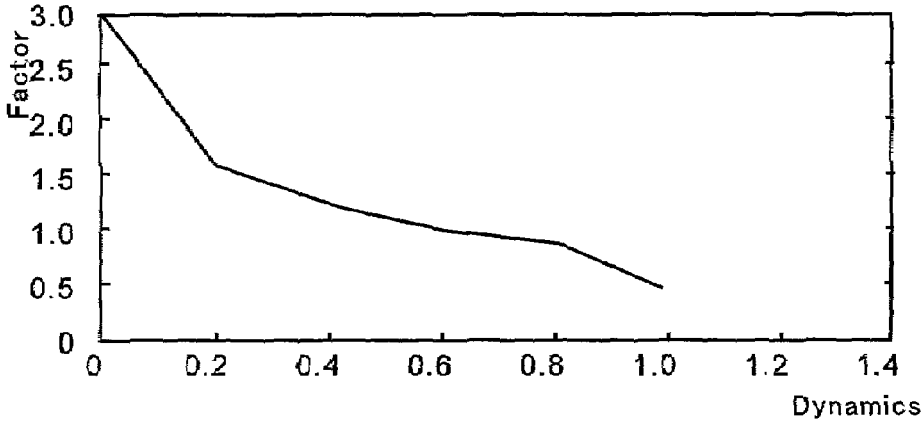
Figure 10C:
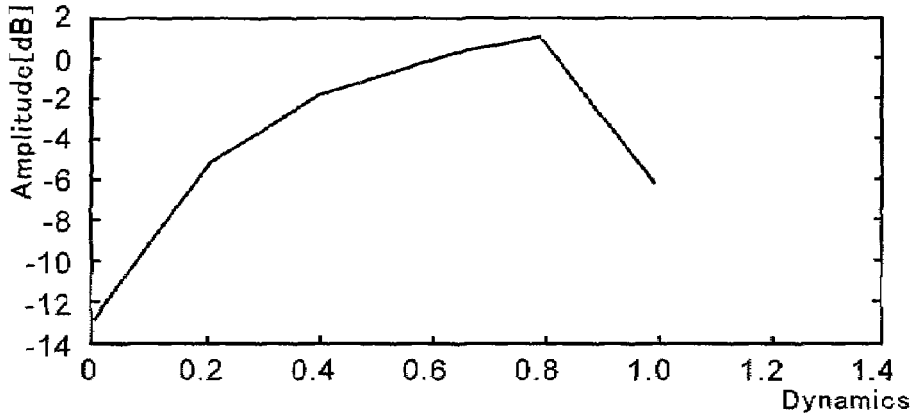

FIGS. 10A to 10C are graphs showing examples of the dynamics function. FIG. 10A is a graph showing a function fEG, FIG. 10B is a graph showing a function fES, and FIG. 10C is a graph showing a function fESD.

By using the functions fEG, fES and fESD shown in FIGS. 10A to 10C, the dynamics value is reflected upon the feature parameters ExcitationGain (EG), ExcitationSlope (Es) and ExcitationSlopeDepth (ESD).

All of the functions fEG, fES and fESD shown in FIGS. 10A to 10C are input with a dynamics value which takes a value from 0 to 1. The feature parameters EG', ES' and ESD' are calculated by the following equations (K1) to (K3) by using the functions fEG, fES and fESD to use as the feature parameters at the dynamic value dyn:

$$EG'=fEG(dyn) \quad \text{(K1)}$$

$$ES'=ES\times fES(dyn) \quad \text{(K2)}$$

$$ESD'=ESD+fESD(dyn) \quad \text{(K3)}$$

The functions fEG, fES and fESD shown in FIGS. 10A to 10C are only illustrative. By using various functions for singers, voices having more naturalness can be synthesized.

Figure 11:
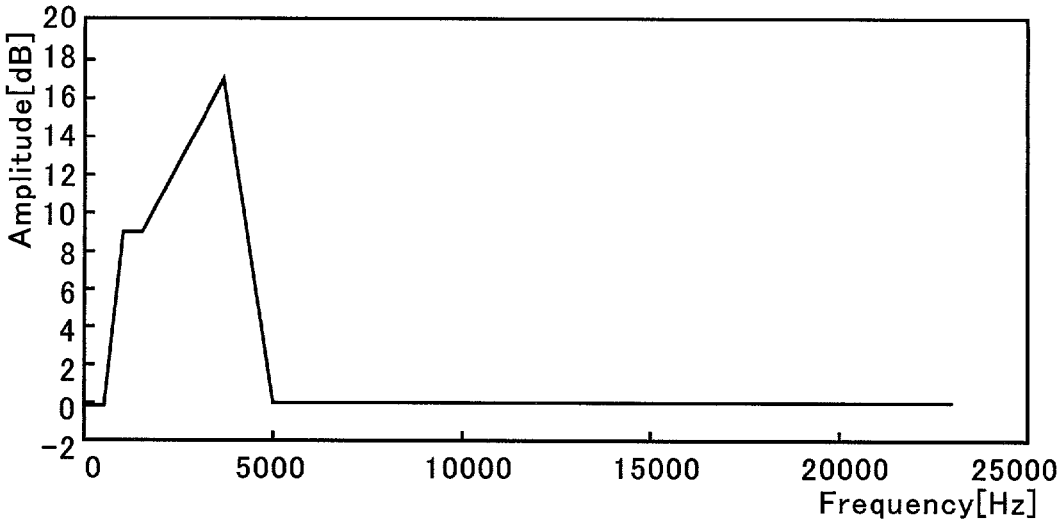
FIG. 11 is a graph showing an example of an opening function.

FIG. 11 is a graph showing an example of the opening function. In FIG. 11, the horizontal axis represents a frequency (Hz) and the vertical axis represents an amplitude (dB).

An excitation resonance frequency ERFreq' is obtained from the excitation resonance frequency ERFreq by using the following equation (L1) to use it as the feature parameters at the opening value Open:

$$ER\text{Freq}'=ER\text{Freq}+f\text{Open}(ER\text{Freq})\times(1-\text{Open}) \quad \text{(L1)}$$

where fOpen (freq) is the opening function.

An i-th formant frequency FormantFreqi' is obtained from the i-th formant frequency FormantFreqi by using the following equation (L2) to use it as the feature parameters at the opening value Open:

$$\text{FormantFreq}_i'=\text{FormantFreq}_i+f\text{Open}(\text{FormantFreq}_{11})\times(1-\text{Open}) \quad \text{(L2)}$$

In this manner, the amplitudes of formants in the frequency range from 0 to 500 Hz can be increased or decreased in proportion to the opening value so that synthesized voices can be given a change in voice to be caused by the lip opening degree.

Synthesized voices can be changed in various ways by preparing the functions to be input with opening values for each singer and changing the functions.

Figure 12:
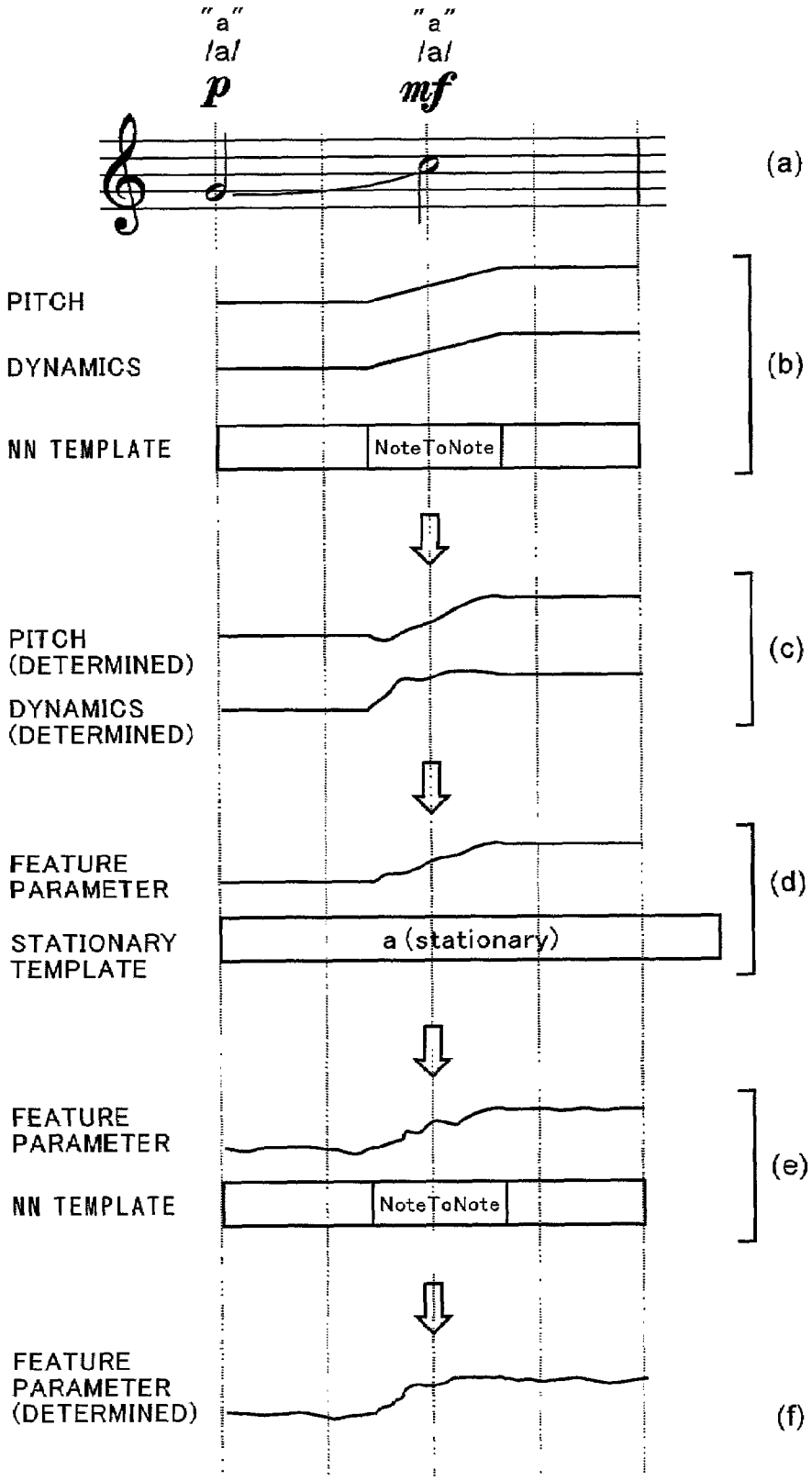
FIG. 12 is a diagram illustrating an example of a first application of templates according to the embodiment.

FIG. 12 is a diagram illustrating an example of a first application of templates according to the embodiment. Voices of a song shown by a score at (a) in FIG. 12 are synthesized by the embodiment method.

In this score, the pitch of the first half note is "so", the intensity is "piano (soft)", and the pronunciation is "a". The pitch of the second half note is "do", the intensity is "mezzo-forte (somewhat loud)", and the pronunciation is "a". Since the two notes are concatenated by legato, two voices are smoothly concatenated without any pose.

It is assumed that a transition time from "so" to "do" is given within the input data (score).

First, the frequencies of two pitches are given from the sound names of the notes. Thereafter, the end and start points of the two pitches are interconnected by a straight line to obtain the pitches in the boundary area between the notes as indicated at (b) in FIG. 12.

Values corresponding to the intensity symbols such as "piano (soft)" and "mezzo-forte (somewhat loud)" are stored beforehand in a table. By using this table, the intensity symbol is converted into the intensity value to obtain dynamics values of the two notes. By interconnecting the obtained two dynamics values, the dynamics values in the boundary area between the notes as indicated at (b) in FIG. 12 can be obtained.

If the pitches and dynamics values obtained in the above manner are used, the pitches and dynamics change abruptly in the boundary area. In order to concatenate the notes by legato, the NN template is applied to the boundary area as indicated at (b) in FIG. 12.

In this case, the NN template is applied only to the pitches and dynamics to obtain pitches and dynamics which smoothly concatenate the boundary area between two notes as indicated at (c) in FIG. 12.

Next, by using the pitches and dynamics determined as indicated at (c) in FIG. 12 and the phoneme name "a" as indices, the feature parameters at each timing are obtained from the Timbre database TDB as indicated at (d) in FIG. 12.

The stationary template corresponding to the phoneme name "a" as indicated at (d) in FIG. 12 is applied to the feature parameters at each timing to add voice fluctuation to the stationary parts other than the concatenated points at the boundaries of the notes and obtain the feature parameters as indicated at (e) in FIG. 12.

The NN template for the remaining parameters (such as formant frequencies) excepting the pitches and dynamics applied as indicated at (b) in FIG. 12 is applied to the feature parameters indicated at (e) in FIG. 12 to add fluctuation to the formant frequencies and the like in the boundary area between the notes as indicated at (f) in FIG. 12.

Lastly, by using the pitches and dynamics indicated at (c) in FIG. 12 and the feature parameters indicated at (f), voices are synthesized so that the song of the score indicated at (a) can be synthesized.

Figure 13:
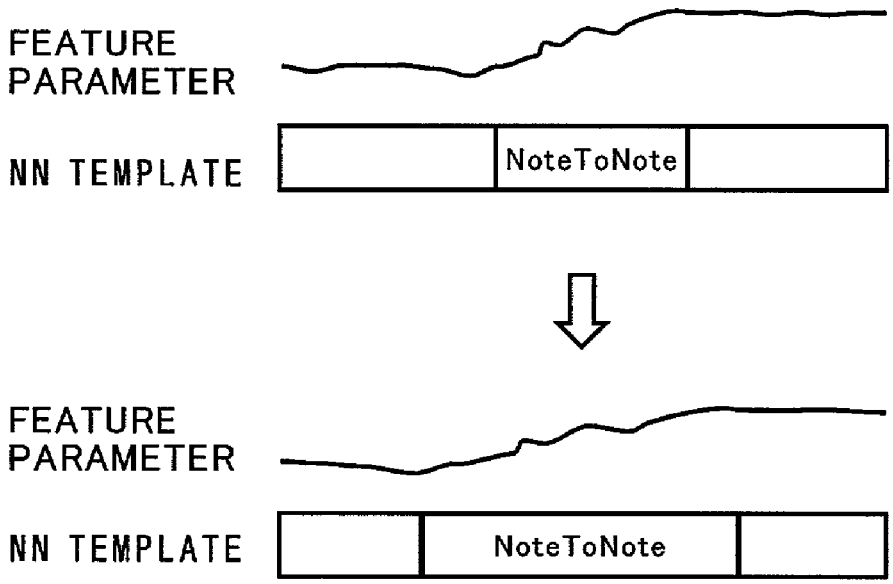
FIG. 13 is a diagram illustrating a modification of the first application of templates according to the embodiment.

The time width of the NN template as indicated at (b) in FIG. 12 can be broadened, for example, as shown in FIG. 13. As shown in FIG. 13, as the time width of the NN template is broadened, the stretched NN template is applied so that voices of a song can be synthesized having a gentle change.

Conversely, if the time width of the NN template is narrowed, voices of a song can be synthesized having a quick and smooth change. By controlling the application time of the NN template, the transition speed can be controlled.

Even if the pitch is changed from one frequency to another frequency in the same time period, there are different singing methods of changing quickly in the first half part and changing slowly in the last half, or vice versa. There are several different pitch change methods, and this difference results in a musical listening difference. If a plurality type of NN templates are formed from voices vocalized in different ways of legato, synthesized voices can have many variations.

There are many methods of changing the pitch including legato. Templates for these voices may also be recorded.

For example, there is glissando by which the pitch is changed at each halftone or the pitch is changed stepwise only at the scale of a key of a song (e.g., in C major, do, re, mi, fa, so, la, ti, do), as different from legato by which the pitch is changed perfectly continuously.

If an NN template is formed from actual voices vocalized by glissando and applied to voices, voices concatenating two notes smoothly can be synthesized.

In this embodiment, the NN template used is formed from voices of the same phoneme and different pitches. An NN template may be formed from voices of different phonemes such as from "a" to "e" and different pitches. In this case, although the number of NN templates increases, synthesized voices can be made more like actual voices of a song.

Figure 14:
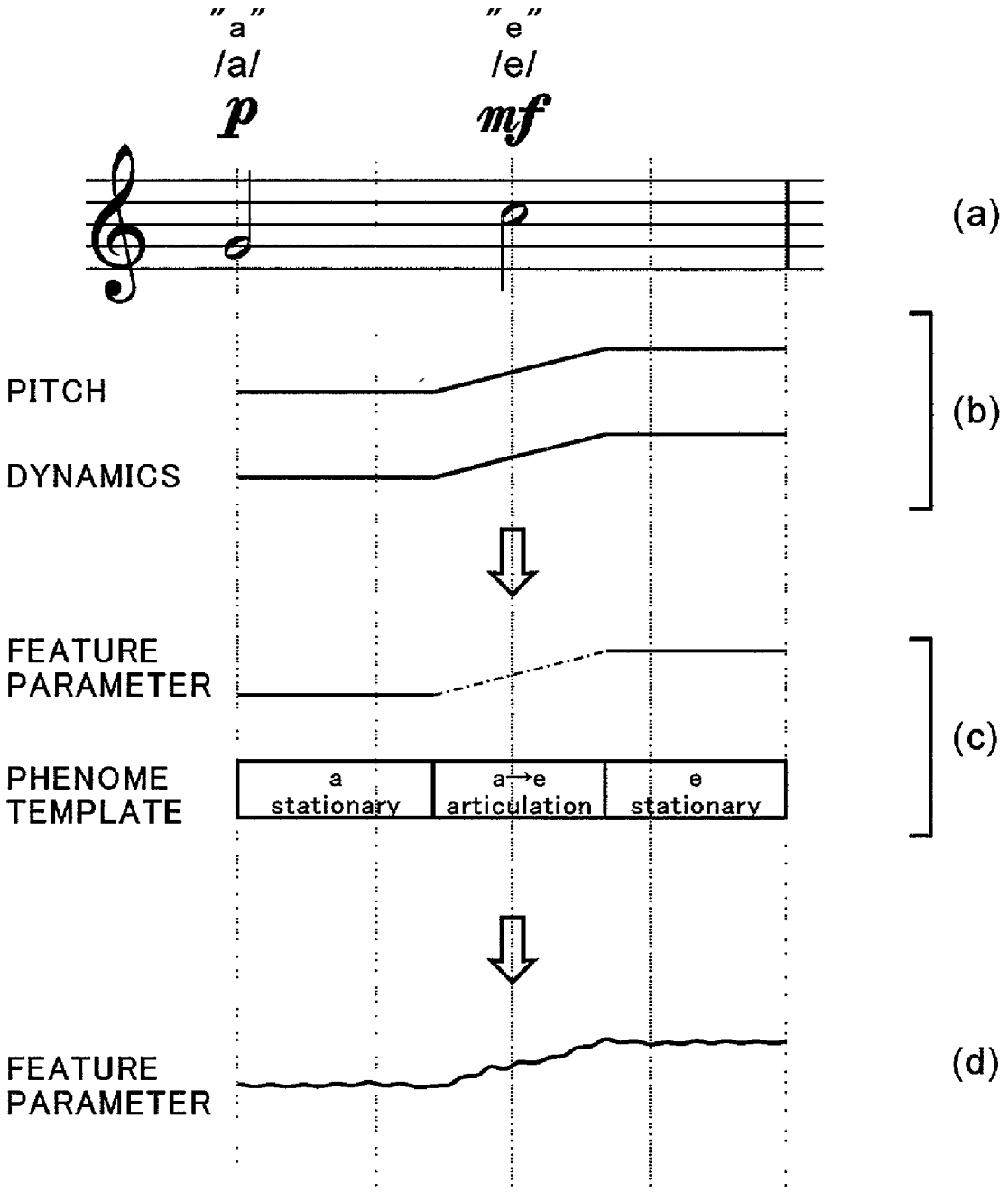
FIG. 14 is a diagram illustrating an example of a second application of templates according to the embodiment.

FIG. 14 is a diagram illustrating an example of a second application of templates according to the embodiment. Voices of a song shown by a score at (a) in FIG. 13 are synthesized by the embodiment method.

In this score, the pitch of the first half note is "so", the intensity is "piano (soft)", and the pronunciation is "a". The pitch of the second half note is "do", the intensity is "mezzo-forte (somewhat loud)", and the pronunciation is "e".

It is assumed that an articulation time from "a" to "e" is set to a fixed value for each of the combinations of two phonemes, or given when the input data is given.

First, the frequencies of two pitches are given from the pitch names of the notes. Thereafter, the end and start points of the two pitches are interconnected by a straight line to obtain the pitches in the boundary area between the notes as indicated at (b) in FIG. 14.

Values corresponding to the intensity symbols such as "piano (soft)" and "mezzo-forte (somewhat loud)" are stored beforehand in a table. By using this table, the intensity symbol is converted into the intensity value to obtain dynamics values of the two notes. By interconnecting the obtained two dynamics values, the dynamics values in the boundary area between the notes as indicated at (b) in FIG. 14 can be obtained.

Next, by using the pitches and dynamics determined as indicated at (b) in FIG. 14 and the phoneme names "a" and "e" as indices, the feature parameters at each timing are obtained from the Timbre database TDB as indicated at (c) in FIG. 14. The feature parameters in the articulation part are obtained by linear interpolation, for example, by using a straight line interconnecting the end point of the phoneme "a" and the start point of the phoneme "e".

Next, as indicated at (c) in FIG. 14, a stationary template of "a", an articulation template from "a" to "e" and a stationary template of "e" are applied to the corresponding ones of the feature parameters to obtain feature parameters as indicated at (d) in FIG. 14.

Lastly, by using the pitches and dynamics indicated at (b) in FIG. 14 and the feature parameters indicated at (d), voices are synthesized.

We can synthesize voices of the song capable of changing naturally from "a" to "e" similar to actual voices sung by a singer.

Similar to the NN template, if the length of the boundary area (articulation part) is given within the score, the articulation time from "a" to "e" can be controlled and voices changing slowly or voices changing quickly can be synthesized by stretching or shrinking one template. The phoneme transition time can therefore be controlled.

Figure 15:
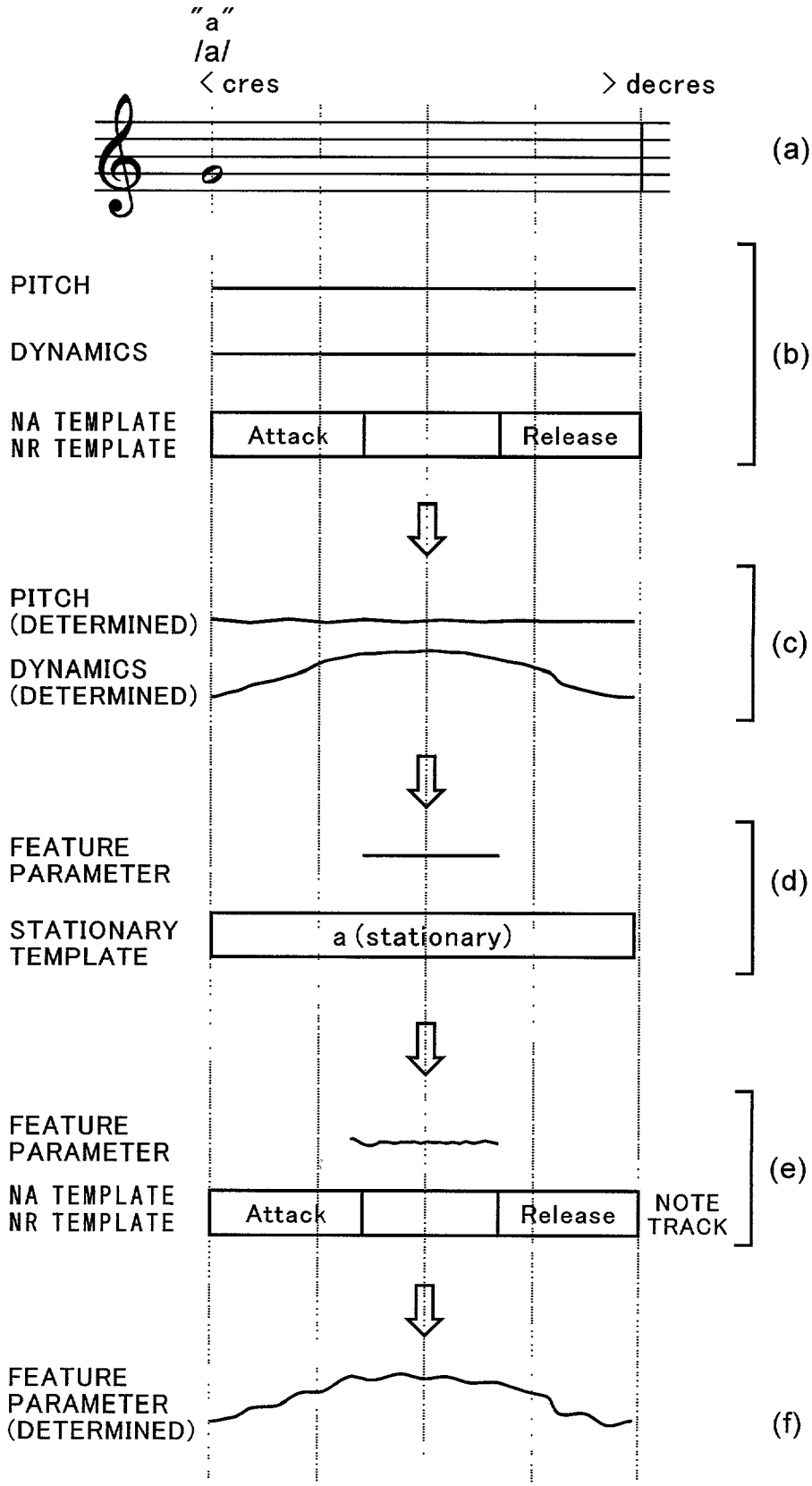
FIG. 15 is a diagram illustrating an example of a third application of templates according to the embodiment.

FIG. 15 is a diagram illustrating an example of a third application of templates according to the embodiment. Voices of a song shown by a score at (a) in FIG. 14 are synthesized by the embodiment method.

In this score, the pitch of the whole note is "so", the pronunciation is "a", and the intensity of the whole note is gradually raised in the rising part and gradually lowered in the falling part.

In this score, the pitches and dynamics are flat as indicated at (b) in FIG. 15. The NA template is applied to the start of the pitches and dynamics, and the NR template is applied to the end of the note, to thereby obtain and determine the pitches and dynamics as indicated at (c) in FIG. 15.

It is assumed that the lengths of the NA template and NR template to be applied are input directly from the crescendo symbol and decrescendo symbol.

Next, by using the determined pitches and dynamics indicated at (c) in FIG. 15 and the phoneme name "a" as indices, the feature parameters in the intermediate part which is neither the attack part nor the release part are obtained as indicated at (d) in FIG. 15.

The stationary template is applied to the feature parameters in the intermediate part indicated at (d) in FIG. 15 to obtain feature parameters given fluctuation as indicated at (e) in FIG. 15. By using these feature parameters indicated at (e) in FIG. 15, the feature parameters in the attack part and release part are obtained.

The feature parameters in the attack part are obtained by applying the NA template of the phoneme "a" by Type 2 to the start point of the intermediate part (end point of the attack part).

The feature parameters in the release part are obtained by applying the NR template of the phoneme "a" by Type 1 to the end point of the intermediate part (start point of the release part).

In the above manner, the feature parameters in the attack, intermediate and release parts are obtained as indicated at (f) in FIG. 15. By using these feature parameters and the pitches and dynamics indicated at (c) in FIG. 15, voices of the song of the score indicated at (a) in FIG. 15 and sung by crescendo and decrescendo can be synthesized.

According to the embodiment, the feature parameters are modified by using phoneme templates obtained by analyzing actual voices sung by a singer. It is therefore possible to generate natural synthesized voices reflecting the characteristics of a stretched vowel part and a phonetic transition of voices of the song.

According to the embodiment, the feature parameters are modified by using phoneme templates obtained by analyzing actual voices sung by a singer. It is therefore possible to generate synthesized voices having musical intensity expression that is not a mere volume difference.

According to the embodiment, even if data providing finely changed musical expression such as pitches, dynamics and opening is not prepared, other data can be used through interpolation. Therefore, the number of samples can be made small so that the size of a database can be made small and the time for forming the database can be shortened.

According to the embodiment, even if the database using as an index only the pitch as musical expression is used, similar effects of using a database using as indices three musical expressions including pitches, opening and dynamics can be obtained mimetically by using the opening and dynamics functions. In this embodiment, as shown in FIG. 2 although the input data Score is constituted of the phoneme track PHT, note track NT, pitch track PIT, dynamics track DYT and opening track OT, the structure of the input data Score is not limited only thereto.

For example, a vibrato track may be added to the input data Score shown in FIG. 2. The vibrato track records a vibrato value from 0 to 1.

In this case, a function that returns a sequence of pitches and dynamics by using a vibrato value as an argument or stores a table of vibrato templates is stored in the database 4.

In calculating the pitches and dynamics at Step SA5 shown in FIG. 4, the vibrato template is applied so that pitches and dynamics added the vibrato effects can be obtained.

The vibrato template can be obtained by analyzing actual human singing voice.

Although this embodiment has been described mainly with respect to singing voice synthesis, the embodiment is not limited only thereto, but voices of general conversation and sounds of musical instruments may also be synthesized.

The embodiment may be realized by a computer or the like installed with a computer program and the like realizing the embodiment functions.

In this case, the computer program and the like realizing the embodiment functions may be stored in a computer readable storage medium such as a CD-ROM and a floppy disc to distribute it to a user.

If the computer and the like are connected to the communication network such as a LAN, the Internet and a telephone line, the computer program, data and the like may be supplied via the communication network.

The present invention has been described in connection with the preferred embodiments. The invention is not limited only to the above embodiments. It is apparent that various modifications, improvements, combinations, and the like can be made by those skilled in the art.

The invention claimed is:

1. A voice synthesizing apparatus comprising:

a timbre storing device that stores voice feature parameters of a plurality of phoneme, each parameter having a plurality of different pitches for each phoneme represented by a same phoneme symbol and being indexed by a phoneme name and a pitch;

a phoneme template storing device that stores a plurality of templates each having a sequence of feature parameters disposed at a predetermined time interval and being indexed by a phoneme name and a pitch, the templates including a stationary template derived from voices having stable phonemes and an articulation template derived from voices in a concatenated part of the phonemes;

a note template storing device that stores a plurality of templates each having a sequence of feature parameters disposed at a predetermined time interval and being indexed by a phoneme name and a pitch, the templates including at least a note attack template having feature parameters in a voice rising part and a note-to-note template having feature parameters in a pitch changing part;

a reading device that reads the feature parameter from the timbre storing device and the templates from the phoneme template storing device and the note template storing device by using information regarding the phoneme and a pitch of a voice to be synthesized changing over time as indices; and a voice synthesizer that synthesizes a voice in accordance with the read feature parameter added with the templates read from the phoneme template storing device and the note template storing device.

2. A voice synthesizing apparatus according to claim 1, wherein the templates stored in the note templates storing device include a note release template having feature parameters in a voice falling part.

3. A voice synthesizing apparatus according to claim 1, wherein each feature parameter in the templates is stored by a differential value.

4. A voice synthesizing apparatus according to claim 1, further including a calculator that calculates a voice feature parameter matching a pitch of the voice to be synthesized by interpolation, when the voice feature parameter matching a pitch of the voice to be synthesized is not stored in the timbre storing device.

5. A voice synthesizing apparatus according to claim 1, wherein the articulation template is lineally stretched.

6. A voice synthesizing apparatus according to claim 1, wherein the reading device reads the note-to-note template in accordance with an added value of a weighted change amount of frequencies and an average value of start pitches and end pitches.

7. A voice synthesizing apparatus according to claim 1, wherein the feature parameters further is indexed by dynamics.

8. A voice synthesizing apparatus according to claim 1, wherein the feature parameters further is indexed by a lip opening value.

9. A voice synthesizing method comprising:

reading a feature parameter, by using as indices information regarding a phoneme and a pitch of a voice to be synthesized, from a timbre storing means which stores voice feature parameters of a plurality of phoneme, each parameter having a plurality of different pitches for each phoneme represented by a same phoneme symbol, and the feature parameter being indexed by a phoneme name and a pitch;

reading a template, by using as indices information regarding a phoneme and a pitch of a voice to be synthesized changing over time, from a phoneme template storing means which stores a plurality of templates, each template having a sequence of feature parameters disposed at a predetermined time interval and being indexed by a phoneme name and a pitch, the templates including a stationary template derived from voices having stable phonemes and an articulation template derived from voices in a concatenated part of the phonemes;

reading a template, by using as indices information regarding a phoneme and a pitch of a voice to be synthesized, from a note template storing means which stores a plurality of templates, each template having a sequence of feature parameters disposed at a predetermined time interval and being indexed by a phoneme name and a pitch, the templates including at least a note attack template having feature parameters in a voice rising part and a note-to-note template having feature parameters in a pitch changing part; and synthesizing a voice in accordance with the read feature parameter added with the templates read from the phoneme template storing means and the note template storing means.

10. A computer-readable storage medium having encoded thereon, program code including instructions which when executed cause:

reading a feature parameter, by using as indices information regarding a phoneme and a pitch of a voice to be synthesized, from a timbre storing means which stores voice feature parameters of a plurality of phoneme, each parameter having a plurality of different pitches for each phoneme represented by a same phoneme symbol, and the feature parameter being indexed by a phoneme name and a pitch;

reading a template, by using as indices information regarding a phoneme and a pitch of a voice to be synthesized changing over time, from a phoneme template storing means which stores a plurality of templates, each template having a sequence of feature parameters disposed at a predetermined time interval and being indexed by a phoneme name and a pitch, the templates including a stationary template derived from voices having stable phonemes and an articulation template derived from voices in a concatenated part of the phonemes;

reading a template, by using as indices information regarding a phoneme and a pitch of a voice to be synthesized, from a note template storing means which stores a plurality of templates, each template having a sequence of feature parameters disposed at a predetermined time interval and being indexed by a phoneme name and a pitch, the templates including at least a note attack template having feature parameters in a voice rising part and a note-to-note template having feature parameters in a pitch changing part; and synthesizing a voice in accordance with the read feature parameter added with the templates read from the phoneme template storing means and the note template storing means.

* * * * *